US008756956B2

(12) United States Patent
Dudzik et al.

(10) Patent No.: US 8,756,956 B2
(45) Date of Patent: Jun. 24, 2014

(54) LAUNDRY TREATMENT DEVICE

(75) Inventors: Rainer Dudzik, Oberreichenbach (DE); Rainer Jurmann, Falkensee (DE); Thomas Kaltofen, Berlin (DE); Martin Schaller, Remchingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1064 days.

(21) Appl. No.: 12/527,702

(22) PCT Filed: Mar. 13, 2007

(86) PCT No.: PCT/EP2007/052367

§ 371 (c)(1),
(2), (4) Date: Feb. 19, 2010

(87) PCT Pub. No.: WO2008/101549

PCT Pub. Date: Aug. 28, 2008

(65) Prior Publication Data

US 2010/0147038 A1 Jun. 17, 2010

(30) Foreign Application Priority Data

Feb. 22, 2007 (DE) ..... 20 2007 002 626 U

(51) Int. Cl.
*D06F 33/02* (2006.01)
*D06F 37/20* (2006.01)

(52) U.S. Cl.
USPC ..... 68/12.04; 68/12.06; 68/12.27

(58) Field of Classification Search
USPC ..... 68/12.04, 12.05, 12.21, 12.27, 12.06
See application file for complete search history.

(56) References Cited

U.S. PATENT DOCUMENTS

| | | | | | |
|---|---|---|---|---|---|
| 5,152,159 | A * | 10/1992 | Kabeya et al. | 68/12.02 |
| 5,561,991 | A | 10/1996 | Berkcan et al. | |
| 6,065,170 | A | 5/2000 | Jang | |
| 6,363,755 | B1 * | 4/2002 | Hapke et al. | 68/12.26 |
| 6,776,057 | B1 * | 8/2004 | May | 73/862.333 |
| 6,803,760 | B2 * | 10/2004 | Jones et al. | 324/207.25 |
| 7,631,522 | B2 * | 12/2009 | Bindocci et al. | 68/12.04 |
| 8,082,763 | B2 * | 12/2011 | Giordano | 68/12.04 |
| 8,250,690 | B2 * | 8/2012 | Jurmann et al. | 8/158 |
| 2004/0035221 | A1 * | 2/2004 | May | 73/862.331 |
| 2006/0283211 | A1 * | 12/2006 | Bindocci et al. | 68/12.05 |
| 2007/0251023 | A1 * | 11/2007 | Koo et al. | 8/158 |
| 2008/0134727 | A1 * | 6/2008 | May | 68/12.02 |
| 2009/0217711 | A1 * | 9/2009 | May | 68/12.04 |

FOREIGN PATENT DOCUMENTS

| | | | | |
|---|---|---|---|---|
| DE | 3938822 | A1 | 5/1991 | |
| EP | 1167609 | A1 | 1/2002 | |
| EP | 1426319 | A1 * | 6/2004 | |
| GB | 2225030 | A * | 5/1990 | D06F 39/00 |
| JP | 10-156081 | A | 6/1998 | |
| WO | WO 2007017136 | A1 * | 2/2007 | |

* cited by examiner

*Primary Examiner* — Joseph L Perrin
(74) *Attorney, Agent, or Firm* — Nixon & Vanderhye P.C.

(57) ABSTRACT

A laundry treatment device includes a housing, a container suspended in the housing in an oscillating manner, and a detecting unit for detecting one of the position and the arrangement of the container in the housing. The detecting unit includes a magnetic field-generator that generates a magnetic field; and a magnetic field detector for detecting a magnetic flux density of the magnet field and for determining a direction of field lines of the magnet field.

27 Claims, 2 Drawing Sheets

LAUNDRY TREATMENT DEVICE

BACKGROUND OF THE INVENTION

The invention relates to a laundry treatment device, in particular a washing machine, a washer/dryer or a tumble dryer, with a housing, with a container suspended in the housing in an oscillating manner and a unit for detecting the position and/or the arrangement of the container in the housing, where the detection unit comprises an magnetic field-generating element and a detector unit for detecting a magnetic flux density of the magnetic field.

A washing machine with a housing, in which a washing liquor container is arranged in an oscillating manner on hangers is known from EP 972 874 A1. The washing machine comprises a permanent magnet, which is arranged on one of the hangers, and a Hall element, which is attached to an essentially fixed element of the washing machine. In the case of a change in the distance between the magnet and the Hall element, the magnetic flux density detected by the Hall element changes. As the fixed element is also essentially at rest relative to the housing, the distance at the same time indicates the arrangement of the container in the housing. The Hall element can generate an electrical signal proportional to the distance, which is fed to a control unit of the washing machine for the purposes of measuring the weight and imbalance. A disadvantage of the known method is that the measurement unit of the known washing machine enables only detection of the container arrangement in the direction of the hanger arms. During a treatment process, in particular during a spin sequence, the container can also be deflected in horizontal directions. In order reliably to avoid the container striking the housing, horizontal movements too must be detected.

A washing machine with a unit for the measurement of a container arrangement in a housing is also known from DE 39 38 822 A1. This washing machine has an optical distance measurement unit, which can likewise only detect the container arrangement in a vertical direction. Such an optical measurement unit can easily become soiled in a washing machine, making it highly susceptible to faults.

BRIEF SUMMARY OF THE INVENTION

The object of the invention is thus to create a laundry treatment device which removes the aforementioned disadvantages, in particular which enables reliable operation of the same. In addition the laundry treatment device should be equipped such that the most precise measurement of load and imbalance is enabled.

The inventive laundry treatment device has a housing, with a container suspended in the housing in an oscillating manner and a unit for detecting the position and/or the arrangement of the container in the housing. The laundry treatment device has a detection unit, which comprises a magnetic field-generating element and a detector unit for detecting a magnetic flux density of the magnetic field, where the detector unit according to the invention has a unit for determining the field line directions of the magnetic field. As is known, magnets have their typical field line configurations. Thus when a magnet with known characteristics of the magnetic field is used, not only can the distance be determined, as a function of the magnetic flux density between the detector unit and the magnet, but also a lateral shift. The arrangement of the magnet in relation to the detector unit can thus be determined in a multiplicity of spatial coordinates. Such a detection unit can be of very simple construction, and according to the design of the magnet and the sensors, can be employed as a two-axis sensor or preferably as a three-axis sensor. A two-axis sensor determines the arrangement with reference to two Cartesian spatial coordinates and a three-axis sensor with reference to three Cartesian spatial coordinates. The movement of the container within the compartment can thus be monitored with such a sensor. Critical states, for example where the container strikes fixed components of the laundry treatment device, can be detected before such contact takes place. The movement of the washing liquor container can thus be simply monitored, and control measures initiated upon the exceeding of prescribed spatial boundaries.

Advantageously, the unit for detecting the position and/or the arrangement of the container for determining a position and/or an arrangement of the container is embodied in at least two spatial coordinates, which are determined by the magnetic flux density and the direction of the field lines. It is favorable here if the unit comprises a arithmetic unit, which can perform conversion of the detected magnetic flux density and the detected field line direction into the spatial coordinates by means of predetermined calculation rules The calculation rules can be simply stored in a memory of the unit. In particular, such calculation rules can be simply adjusted in line with geometric relationships of the laundry treatment devices and installation-related influences on the detector unit (location, electrical interference, zero point), with the relevant interdependencies being determined by means of trials.

The magnetic flux density can be particularly simply detected by means of so-called Hall elements. It has been demonstrated that the direction of a magnetic field line can also be determined with such elements. The detector unit preferably comprises a multiplicity of Hall elements.

To determine the arrangement and/or the position of the washing liquor container the magnetic field-generating element is arranged on the container and the detector unit on a fixed component of the laundry treatment device opposite the container, in particular on a housing component. As the geometric dimensions of the housing and of the container are known, conclusions can be drawn about the arrangement of the container from the magnetic flux density and the determined field line direction, as in the case of a change in the arrangement of the container, the magnetic flux density and/or the field line direction vary at the detector unit according to the changed arrangement of the magnetic field. The changed arrangement of the container within the housing can thus be determined at any time with the detector unit.

In an alternative development of the invention, the magnetic field-generating element can also be arranged on a fixed component of the laundry treatment device opposite the container, in particular on a housing component, and the detector unit can be arranged on the container. In this case too, with the detector unit the arrangement of the container with reference to a fixed part of the laundry treatment device can be established simply through the detection of the arrangement of the magnetic field-generating element in relation to the detector unit.

The magnetic field-generating element can be a permanent magnet. The permanent magnet has the particular advantage that its magnetic field is permanently impressed and the characteristics with reference to the magnetic field strength and the alignments of the magnetic field lines are known. Such permanent magnets also retain their magnetic properties constantly over a very long duration. The detector unit and/or the arithmetic unit can be simply adjusted in line with the known magnetic properties. As well as such permanent magnets, electromagnets can also serve as magnetic field-generating elements, in which case the magnetic properties are determined by the structure and the electrical parameters, which can be preset in fixed form by a unit of the laundry treatment device.

Trials have established that an embodiment of the permanent magnet in the form of a ring magnet is particularly favorable. In principle other forms of the permanent magnet, for example in the form of a bar magnet, can also be used within the context of the invention.

In a preferred development of the invention the container comprises at least one element for fixing the arrangement of the part of the detection unit arranged on the container. It is accordingly advantageous if the fixed component, in particular the housing, comprises at least one element for fixing the arrangement of the part of the detection unit arranged on the fixed component. Parts of the detection unit refer to the magnetic field-generating element and the detector unit for detecting the magnetic flux density and the direction of the magnetic field lines. With these developments, the parts of the detection unit can always be arranged in a defined configuration relative to each other in the laundry treatment device. Additional adjustment or orientation of the parts during manufacture of the laundry treatment device can thus be avoided.

The parts of the detection unit are preferably fixed in a releasable manner by means of a screw or latched connection. In this way both the part of the detection unit arranged on the container can be connected with the container and the part arranged on the fixed component can be connected with the fixed component. By means of such releasable connections, the components can easily be replaced with new components, for example in the case of a possible customer service callout. Latched connections are in particular expedient for cost-effective manufacture of the laundry treatment device, as additional fixing material, such as screws, can be dispensed with, and just one simple assembly step is required.

In an alternative development provision can also be made for the permanent magnet to be connected in a non-detachable manner with the container, in particular by means of thermal welding. The particular advantage lies in the fact that the arrangement of the permanent magnet is permanently impressed and cannot be changed during the operating time. This is possible because it is not essential to provide for exchange of the permanent magnet, because its impressed magnetic field does not change significantly over the service life of the laundry treatment device.

The laundry treatment device is further developed in that advantageously at least one stop element is encompassed by the container and/or by the fixed part, where the stop element is embodied and arranged in such a way that in the case of a movement of the container, the possibility of the detector unit coming into contact with a part lying opposite the detector unit, which can be the container or a part arranged on the container, is excluded. Damage to the detector unit caused by impacts can thus be effectively prevented.

It is particularly advantageous if a unit for determining the weight of laundry load placed in the container is encompassed, where the unit determines the weight of the loaded laundry load depending on the detected position and/or arrangement of the container. The weight of the laundry can here be simply determined from a change in the arrangement of the container, by the arrangement of the container in the direction of the line of gravitation before and after loading of the laundry being determined. The change in the arrangement or path respectively, meaning the difference between the arrangement before and after loading of the laundry, is proportional to the amount of laundry loaded or the weight of laundry loaded, as a container of the laundry treatment device is mounted on spring suspension. The proportionality factor corresponds to the overall spring rate acting in the direction of the earth's gravitational pull.

In a further development the laundry treatment device comprises a unit for determining the imbalance of a drum loaded with laundry and rotatable within the container, where the imbalance determining unit determines an imbalance of the loaded drum, as a function of the detected position and/or arrangement of the container. This makes use of the effect whereby imbalance during rotation of the drum generates a movement of the container, where the size of the amplitude of the movement depends on the degree of imbalance. The amplitude of the movement can be simply determined from the change in the arrangement of the container. It is thus possible at an early stage to detect a critical imbalance, which can cause the container to strike the housing of the laundry treatment device or cause the laundry treatment device to "creep". For example a simple comparison between the detected change in the arrangement and a maximum permissible change in the arrangement is performed, where the maximum permissible change in the arrangement is smaller than the change in the arrangement caused by the critical imbalance. It is here particularly favorable that the detector unit can determine the arrangement in individual spatial coordinates.

BRIEF DESCRIPTION OF THE DRAWINGS

The invention is explained in greater detail below on the basis of an exemplary embodiment depicted in a drawing.

DETAILED DESCRIPTION OF EXEMPLARY EMBODIMENTS OF THE PRESENT INVENTION

The invention is described in greater detail, using a washing machine as an example. It can equally well be used in laundry treatment devices comprising a container suspended in an oscillating manner in a housing.

Figure 1:
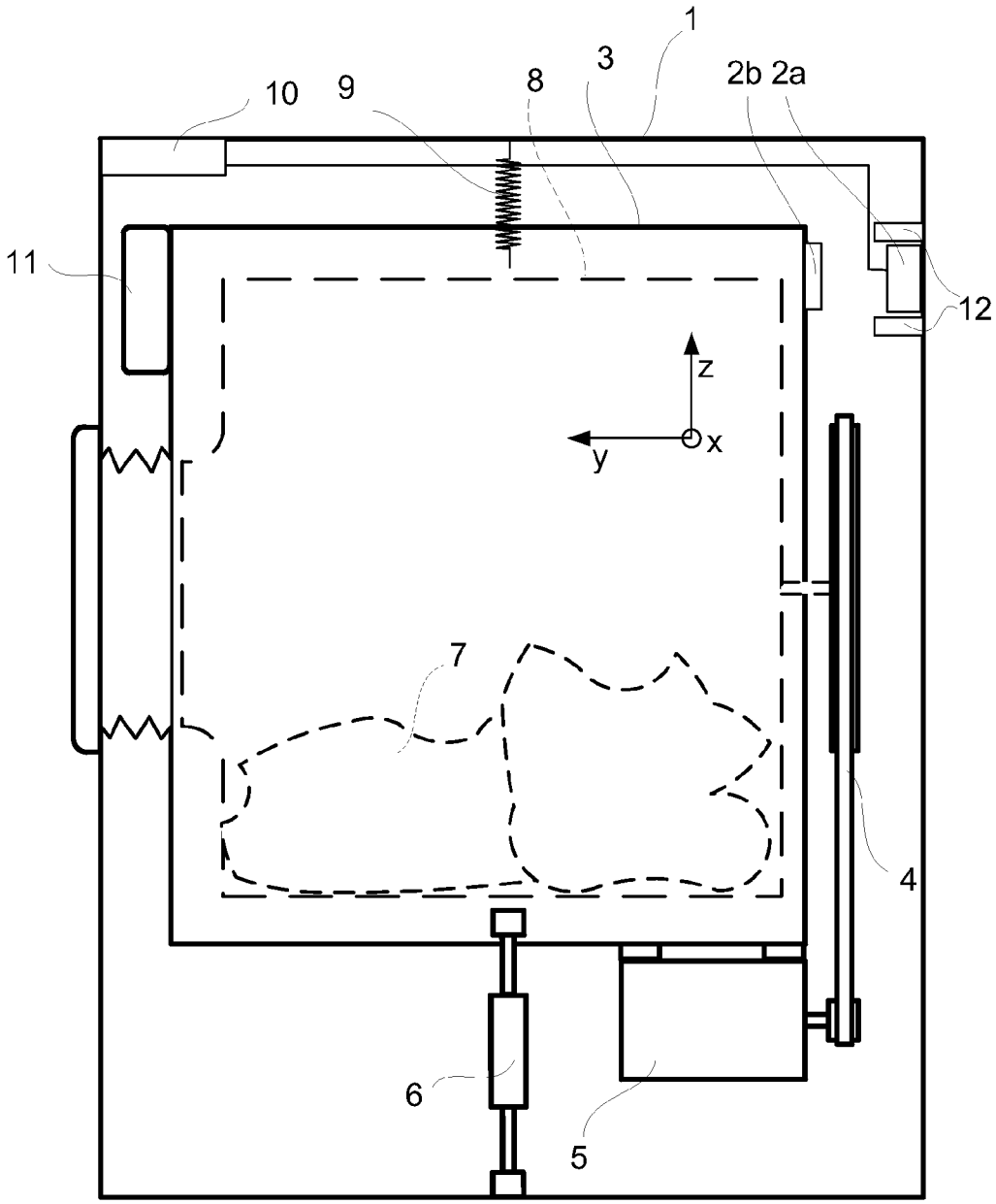
FIG. 1 shows a diagrammatic representation of an inventive washing machine and FIG. 2 represents in diagrammatic form the functional method of a unit for detecting a position by means of a magnetic field-generating element

FIG. 1 shows a washing machine with a housing 1, in which is arranged a washing liquor container 3, hereinafter referred to merely as the container 3, which is suspended on two springs 9 and supported on two spring piston dampers 6. A drum 8 to accommodate laundry 7 is rotatably mounted in the washing liquor container 3. The drum 8 is connected with a motor 5 via a belt drive 4 and has a horizontal axis of rotation. In alternative embodiments of the inventive washing machine, the axis of rotation of the drum can also be embodied in inclined or even vertical form Fixed to the container 3 is a counterweight 11, which in particular offsets the weight of the motor 5. The module formed by the container 3 and the components arranged on it is also designated an oscillator system. The counterweight 11 is so dimensioned and arranged on the container 3 that the center of gravity of the oscillator system is if possible on the axis of rotation of the drum 8 and in the plane formed by the springs 8 and the damper 6.

Before a washing procedure, the drum 8 is usually loaded with laundry 7. The weight of the laundry 7 causes the container 3, subject to lengthening of the springs 9 and contraction of the dampers 6 to sink along an axis Z (orientation along the line of gravitation), until equilibrium is once more established between the weight of the loaded oscillator system and the spring tension force. The change in the spring tension force acting on the oscillator system, that is the displacement of the container 3 along the direction Z multiplied by the overall spring constant acting in this direction, thus corresponds to the weight of the laundry 7. The spring-mounted container 3 here acts as a spring balance. A change in the arrangement or the position of the container 3 along the axis Z is accordingly proportional to the weight of laundry 7 loaded.

During use of the washing machine as directed, rotation of the drum at a lower speed causes, among other effects, movement of the laundry 7 within the drum. The forces thereby acting on the drum cause a movement of the container 3 or an ongoing change in the arrangement of the container 3. In the case of a spinning process, in which the drum is operated at a higher speed of rotation, the laundry 7 settles in a fixed position against the wall of the drum, and an imbalance, depending on distribution of the mass and the position of the laundry 7, results. The forces acting on the container 3 as a result of the imbalance likewise cause a movement or a change in the arrangement of the container 3.

To detect such changes in the arrangement of the container 3, the washing machine has a detection unit 2, which comprises a detector unit 2*a*, which is attached to a fixed part 1 of the washing machine, and a permanent magnet 2*b* attached to the container 3. In the present exemplary embodiment, the fixed part is the rear wall of the housing 1 of the washing machine. In alternative embodiments, the detector unit 2*a* can also be attached to other parts fixedly connected with the housing 1, for example to a bottom plate, to a worktop or to a housing of a dispensing device. It is further possible to attach the detector unit 2*a* to the container 3 and the permanent magnet 2*b* to the fixed part of the washing machine.

Likewise, another magnetic field-generating elements, for example an electromagnet, can be used for further alternative embodiments instead of a permanent magnet.

Figure 2:
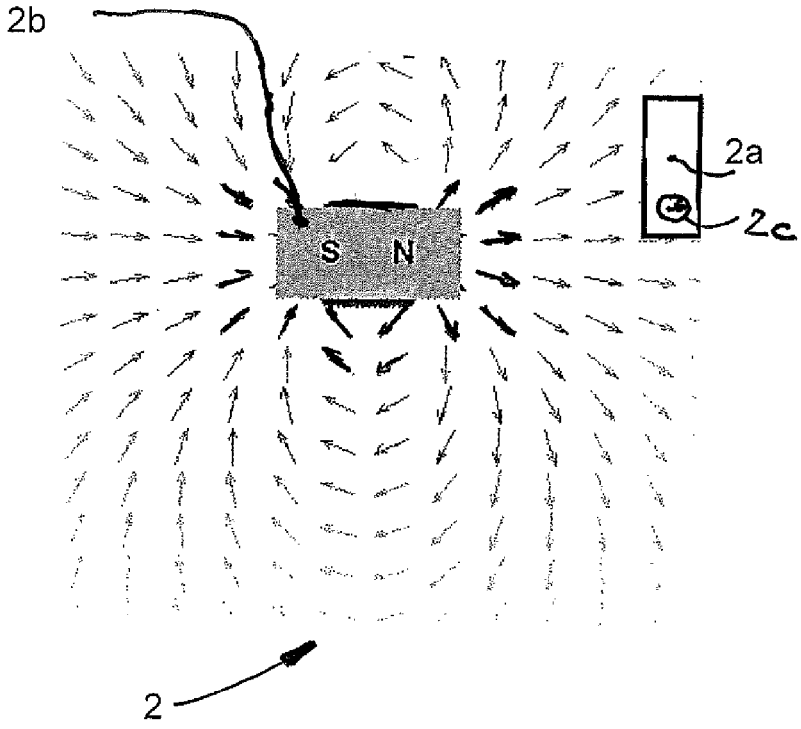

In the exemplary embodiment, the detector unit 2*a* has a multiplicity of Hall elements 2*c*, which can detect the magnetic field generated by the permanent magnet 2*b*. In FIG. 2 only one Hall element 2*c*, out of the Hall elements is shown. The Hall elements 2*c* determine the magnetic flux density at the location of the detector unit 2*a* and the direction of the magnetic field line.

The functional method of the detection unit 2 is shown in greater detail in FIG. 2. The diagram shows a magnetic field around the magnet 2*b* indicated by arrows, where the arrows represent the magnetic field lines and their direction. The field lines run from the north pole N on both sides of the magnet 2*b* to the south pole S, where the magnetic flux density decreases with increased distance from the magnet 2*b*. This effect is indicated by the reduced stroke thickness of the arrows. By means of Hall elements, of which FIG. 2 shows Hall element 2*c*, the magnetic flux density and the field line direction prevailing at the point of detection are detected. These two parameters, magnetic flux density and field line direction, clearly determine the arrangement of the magnet 2*b* in the plane represented in FIG. 2. Accordingly, through the use of further Hall elements, the position of the magnet 2*b* within the compartment can accordingly also be clearly determined.

The Hall elements 2*c* convert the determined magnetic flux density and the field line direction into electrical signals, which are fed to at least one suitable analog/digital converter encompassed by the detector unit 2*a*. In addition the detector unit 2*a* has a processor or arithmetic unit (not shown), which calculates the position of the magnet 2*b* in the plane in two Cartesian spatial coordinates from the converted signals of the flux density and the field line direction. Even if FIG. 2 shows only the functional method in one plane, the same principle can likewise be transferred to the space. Accordingly, the detection unit 2 can also be designated a 3D-sensor, if the detector unit 2*a* is equipped with sufficient Hall elements and the processor determines the position of the magnet 2*b* in all three Cartesian spatial coordinates. The spatial coordinates X, Y, Z are shown in FIG. 1.

The processor comprises a memory unit, in which are stored suitable algorithms and conversion factors for calculating the spatial coordinates X, Y and Z, as a function of the magnetic flux density and the field line direction. The conversion factors are simple to determine on the basis of practical trials.

The spatial coordinates X, Y, Z determined by the detector unit 2*a* are fed to a control unit 10 encompassed by the washing machine and connected with the detector unit 2*a*. In the control unit 10, algorithms and constants are stored in a memory unit, in order to calculate from the spatial coordinates X, Y and Z a shift of the container 3 caused by the laundry load 7. The shift of the container 3 is determined in the plane represented by the springs 8 and dampers 6 and accordingly converted into a weight value for the laundry load 7. Such a weight value can be fed to a suitable display unit, on which the weight of the laundry can be indicated to a person operating the device. In addition the control unit 10 is set up to control the course of washing, rinsing, spinning and/or drying processes, where the control unit 10 of the inventive washing machine can control the named processes depending on the laundry weight determined.

Further, the control unit 10 is also set up to determine an imbalance from the arrangement or the change in the arrangement of the container 3. With an encompassed comparison unit, the imbalance value determined is compared with a permissible imbalance value. Depending on the result of the comparison the control unit 10 can thereby control the course of the spinning process, in particular in relation to its duration, the speed of rotation of the drum and the acceleration of the drum. The permissible imbalance value is stored in a memory in a storage unit of the control unit 10, and is set at a level such that forces and movements generated by the imbalance during spinning do not exceed a predetermined value. With continuous interrogation of the current arrangement, secure operation of the washing machine is thus possible.

In alternative embodiments, limit values for the arrangement of the container 3 in the spatial coordinates X, Y and Z can be stored in the control unit 10. The arrangement of the container 3 determined is compared with the limit values using a comparison unit, where the limit values are determined such that the container 3 or parts arranged on the container 3 cannot come into contact with other parts of the washing machine as a result of movement of the container 3. Upon the exceeding of one of the limit values, the control unit 10 can initiate measures, for example switching off the motor, which prevent a further movement of the container 3 beyond the limit value.

The unit for determining the weight of the laundry 7 and/or the unit for determining imbalance and their assigned memory and comparison units, which are encompassed in the exemplary embodiment of the control unit 10, can also be part of the detection unit 2. Then only the comparison result determined by the detection unit 2 is fed to the control unit.

In the exemplary embodiment, the permanent magnet 2*b* is embodied as a ring magnet, which is arranged in a housing (not shown), which is connected to the container 3 by means of screws. Accordingly, the detector unit 2*a* has a housing (not shown), which is screwed to the rear wall of the housing 1. Arrangement fixing elements, for example dowels, are provided both on the container 3 and on the housing 1, which engage in a form-fitted manner in the housing of the magnet 2*b* or in the housing of the detector unit 2*a*. In alternative embodiments other customary arrangement fixing elements can also be provided. The magnet 2*b*, its housing or the housing of the detector unit 2*a* can be attached to the container 3*a* or to a fixed part of the washing machine with suitable latched connections.

In a further embodiment, the magnet 2*b* is connected with the container 3 in a non-detachable manner. To this end, the magnet 2*b* is molded into the container 3 or the magnet 2*b* is enclosed in plastic, where the enclosing plastic is thermally welded to the container 3.

Two stop elements 12 are arranged on the rear wall of the housing 1, which are arranged adjacent to the detector unit 2*a* and whose dimensions are such that in the event of a movement of the container 3, contact with the detector unit 2*a* is excluded. In the case of excessive movement of the container 3 one of the stop elements 12 is always touched, preventing damage to the detector unit 2*a* caused by its being struck by the container 3. The stop elements can also be an integral element of the housing of the detector unit. Such stop elements can alternatively or additionally be arranged on the container 3.

The invention claimed is:

1. A laundry treatment device, comprising:

a housing;

a container suspended in the housing in an oscillating manner; and a detecting unit to detect one of the position and the arrangement of the container in the housing, the detecting unit comprising:

a magnetic field-generator structured to generate a magnetic field; and a magnetic field detector to determine a magnetic flux density of the magnet field and a direction of field lines of the magnet field, wherein the detecting unit is configured to determine spatial coordinates associated with the position and the arrangement of the container based on the determined magnetic flux density and the determined direction of the field lines, and wherein a memory unit stores algorithms and/or conversion factors, and a processor is configured to calculate the spatial coordinates as a function of the determined magnetic flux density and the determined direction of field lines in accordance with the stored algorithms and/or conversion factors.

2. The laundry treatment device of claim 1, wherein the detecting unit detects the position and arrangement in at least two different spatial coordinates and comprises an arithmetic unit.

3. The laundry treatment device of claim 1, wherein the magnetic field detector comprises a plurality of Hall elements.

4. The laundry treatment device of claim 1, wherein the magnetic field-generator is on the container and the magnetic field detector is on a fixed component of the laundry treatment device opposite the container.

5. The laundry treatment device of claim 4, wherein the magnetic field detector is on a part of the housing.

6. The laundry treatment device of claim 4, wherein the container comprises an element for fixing a part of the magnetic field generator on the container.

7. The laundry treatment device of claim 4, wherein the fixed component comprises an element for fixing a part of the magnetic field generator arranged on the fixed component.

8. The laundry treatment device of claim 4, further comprising a scale that determines a weight of laundry in the container based upon the detected position and/or arrangement of the container in the housing.

9. The laundry treatment device of claim 4, further comprising an imbalance detector that determines an imbalance of a drum loaded with laundry and rotatably mounted in the container based upon the detected position and/or arrangement of the container in the housing.

10. The laundry treatment device of claim 1, wherein a part of the magnetic field detector is on the container and is releasably connected to the container by a screw or latched connection.

11. The laundry treatment device of claim 1, wherein the magnetic field-generator comprises a permanent magnet.

12. The laundry treatment device of claim 11, wherein the permanent magnet is comprises a ring magnet.

13. The laundry treatment device of claim 11, wherein the permanent magnet is thermally welded to the container.

14. The laundry treatment device of claim 1, wherein the magnetic field-generator is on a fixed component of the laundry treatment device opposite the container and the magnetic field detector is on the container.

15. The laundry treatment device of claim 14, wherein the magnetic field generator is on a housing component.

16. The laundry treatment device of claim 1, wherein one of the container and the fixed part comprises a stop element which prevents contact between the magnetic field detector and a part opposite to the magnetic field detector.

17. The laundry treatment device of claim 1, wherein the magnetic field detector is configured to convert the determined magnetic flux density and the determined direction of field lines into electrical signals.

18. A laundry treatment device, comprising:

a housing;

a container in the housing; and a detecting unit to detect the position and the arrangement of the container relative the housing during a washing procedure, the detecting unit comprising:

a magnetic field-generator structured to generate a magnetic field and which projects from one of the container and the housing; and a magnetic field detector to detect a magnetic flux density of the magnetic field and a direction of field lines of the magnetic field, and which projects from the other one of the container and the housing; and stop elements that project beyond the magnetic field detector on one of the container and the fixed component opposite of the container to prevent contact between the magnetic field detector and one of the container and the housing during the washing procedure.

19. The laundry treatment device of claim 18, further comprising a control device configured to determine spatial coordinates associated with the position and an arrangement of the container based on the magnetic flux density and the direction of the field lines.

20. The laundry treatment device of claim 19, wherein the detecting unit detects the position and arrangement in at least two different spatial coordinates and comprises an arithmetic unit.

21. The laundry treatment device of claim 20, wherein the detecting unit detects the position and arrangement in three different spatial coordinates.

22. A laundry treatment device, comprising:

a support structure;

a container connected to the support structure; and a detecting unit, the detecting unit comprising:

a magnetic field-generator structured to generate a magnetic field, and which projects from one of the container and support structure; and a magnetic field detector to determine a magnetic flux density of the magnetic field and a direction of field lines of the magnetic field, the magnetic field detector being configured to convert the determined magnetic flux density and the determined direction of field lines into electrical signals, the magnetic field detector projecting from the other one of the container and the support structure; and a control device configured to determine spatial coordinates associated with a position and an arrangement of the container based on the determined magnetic flux density and the determined direction of the field lines.

23. The laundry treatment device of claim 22, further comprising stop elements on one of the container and the fixed component opposite of the container to prevent contact between the magnetic field detector and a part of the laundry treatment device opposite to the magnetic field detector.

24. The laundry treatment device of claim 22, wherein the magnetic field-generator is on the container and the magnetic field detector is on the support structure and opposite the magnetic field-generator.

25. The laundry treatment device of claim 22, further comprising a scale that determines a weight of laundry in the container based upon the determined position and/or arrangement of the container in the housing.

26. The laundry treatment device of claim 22, further comprising an imbalance detector that determines an imbalance of a drum loaded with laundry and rotatably mounted in the container based upon the determined position and/or arrangement of the container in the housing.

27. The laundry treatment device of claim 22, further comprising a memory unit that stores algorithms and/or conversion factors, wherein the control device includes a processor configured to calculate the spatial coordinates as a function of the determined magnetic flux density and the determined direction of field lines in accordance with the stored algorithms and/or conversion factors.

* * * * *